US010578101B2

(12) United States Patent
Ehringer et al.

(10) Patent No.: US 10,578,101 B2
(45) Date of Patent: Mar. 3, 2020

(54) ROTARY PUMP COMPRISING A LUBRICATING GROOVE IN THE SEALING STAY

(71) Applicant: Schwäbische Hüttenwerke Automotive GmbH, Aalen-Wasseralfingen (DE)

(72) Inventors: Michael Ehringer, Bad Schussenried (DE); Sven Peters, Bad Schussenried (DE); Gerd Jäggle, Ertingen (DE); Thomas Wahl, Ertingen (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 276 days.

(21) Appl. No.: 15/490,104

(22) Filed: Apr. 18, 2017

(65) Prior Publication Data

US 2017/0306950 A1 Oct. 26, 2017

(30) Foreign Application Priority Data

Apr. 21, 2016 (DE) ..... 10 2016 107 447

(51) Int. Cl.
*F04C 15/00* (2006.01)
*F04C 2/08* (2006.01)
(Continued)

(52) U.S. Cl.
CPC ..... *F04C 15/0088* (2013.01); *F04C 2/086* (2013.01); *F04C 2/10* (2013.01); *F04C 2/30* (2013.01)

(58) Field of Classification Search
CPC ..... F04C 15/0088; F04C 2/086; F04C 2/10
See application file for complete search history.

(56) References Cited

U.S. PATENT DOCUMENTS 3,904,333 A 9/1975 Stoeckelmann
4,927,343 A 5/1990 Lonsberry
(Continued)

FOREIGN PATENT DOCUMENTS

DE 232090 A1 1/1986
DE 3536479 A1 8/1986
(Continued)

OTHER PUBLICATIONS

German Search Report issued in German Patent Application No. 10 2016 107 447.0 dated Jan. 10, 2017, 8 pages.
(Continued)

*Primary Examiner* — Mary Davis
(74) *Attorney, Agent, or Firm* — RatnerPrestia

(57) ABSTRACT

A rotary pump with a rotational direction which can be switched, including: a housing which has a pump space featuring an inlet into a low-pressure region of the pump space for a medium to be pumped and an outlet out of a high-pressure region of the pump space for the medium to be pumped; at least one rotor; at least one bearing for the at least one rotor; at least one sealing stay which axially faces the rotor and separates the low-pressure region from the high-pressure region in the rotational direction of the rotor; and a lubricant feed which feeds a lubricant from the pump space to at least the bearing, wherein the lubricant feed is formed in the sealing stay.

20 Claims, 4 Drawing Sheets

(51) Int. Cl.
*F04C 2/30* (2006.01)
*F04C 2/10* (2006.01)

(56) References Cited

U.S. PATENT DOCUMENTS

| | | | | |
|---|---|---|---|---|
| 6,086,344 | A * | 7/2000 | White | F04C 2/104 418/102 |
| 7,942,649 | B2 * | 5/2011 | Lesther | F04C 11/001 417/248 |
| 2004/0228744 | A1 * | 11/2004 | Nakano | F04C 2/102 417/410.3 |
| 2006/0120896 | A1 | 6/2006 | Morita et al. | |

FOREIGN PATENT DOCUMENTS

| | | | |
|---|---|---|---|
| DE | 102005052346 | A1 | 6/2006 |
| DE | 102009019418 | A1 | 11/2010 |
| DE | 102013202917 | A1 | 8/2014 |

OTHER PUBLICATIONS

Extended European Search Report for EP Application 17167286.8, dated Jun. 14, 2017 with partial translation, 8 pages.
Chinese Office Action for Chinese Application No. 201710266831.7, dated Aug. 9, 2018, with translation, 16 pages.

* cited by examiner

ROTARY PUMP COMPRISING A LUBRICATING GROOVE IN THE SEALING STAY

CROSS REFERENCE TO RELATED APPLICATION

This application claims priority to German Patent Application No. 10 2016 107 447.0, filed Apr. 21, 2016, the contents of such application being incorporated by reference herein.

FIELD OF INVENTION

The invention relates to a rotary pump having a housing which comprises a pump space featuring an inlet into a low-pressure region of the pump space for a medium to be pumped and an outlet out of a high-pressure region of the pump space for the medium to be pumped. The pump also comprises at least one rotor and a bearing for the rotor. The pump also comprises: a sealing stay which axially faces the rotor and separates the low-pressure region from the high-pressure region in the rotational direction of the rotor; and a lubricant feed which feeds a lubricant from the pump space to the bearing. The lubricant feed is formed in the sealing stay, in particular in a region of maximum toothed engagement of the rotor.

BACKGROUND OF THE INVENTION

It is important in rotary pumps for the bearing of the rotor to be well lubricated at all times, in order to preclude the pump becoming damaged or even fretted, to maintain the free movement of the pump, and to avoid or at least slow up wear on the bearing and/or the rotor.

In known applications, the bearing of a pump is supplied with lubricant via the high-pressure region or an external pressure reservoir, wherein the lubrication of the bearing is generally dependent on a rotational direction of the pump, such that when the rotational direction is reversed, the bearing is connected to the low-pressure region of the pump and is thus no longer supplied with lubricant.

SUMMARY OF THE INVENTION

Therefore an aspect of the invention provides a rotary pump in which a lubricant is reliably fed all the time to a bearing when the pump is in operation. The intention is in particular to provide a rotary pump comprising a lubricant feed for a bearing of the rotor which is purposeful and independent of the rotational direction.

One aspect of the invention relates to a rotary pump with a rotational direction which can be switched, comprising: a housing which comprises a pump space featuring an inlet into a low-pressure region of the pump space for a medium to be pumped and an outlet out of a high-pressure region of the pump space for the medium to be pumped; at least one rotor; at least one bearing, in particular a slide bearing, for the at least one rotor; at least one sealing stay which axially faces the rotor and separates the low-pressure region from the high-pressure region in the rotational direction of the rotor; and a lubricant feed which is independent of the rotational direction and feeds a lubricant from the pump space to at least the bearing, wherein the lubricant feed is formed in the sealing stay, in particular in a region of maximum toothed engagement of the rotor.

The housing can comprise one or more parts, for example one or more covers, in order to seal openings. Parts of the housing can form a part of the pump space, for example an axial cover for the pump space or a circumferential wall or a cup-shaped structure for accommodating the at least one rotor.

The rotor can be connected or coupled to a drive, such as for example an electric motor or a shaft which is driven by an internal combustion engine, wherein said drive generates the drive energy for the rotor. The rotor is preferably connected to an electric motor and in particular envisaged for use in a motor vehicle. If the motor vehicle comprises an internal combustion engine as the drive, then the rotary pump can be driven by the electric motor, preferably independently of the internal combustion engine, when for example the internal combustion engine is idle. The rotary pump advantageously comprises the electric motor. The rotary pump is preferably embodied as an electric rotary pump. The rotary pump is preferably embodied as an auxiliary and/or additional pump for assisting and/or at least partially replacing a main or primary pump in a lubricant and/or coolant system of the motor vehicle. The expression "provided" is to be understood in particular to mean "specifically embodied, configured, implemented, arranged and/or programmed".

The rotational direction of the rotary pump can be switched, such that the pump can be flexibly employed. When changing from a first rotational direction to a second rotational direction, the outlet of the pump which is rotating in the first rotational direction becomes the inlet of the same pump which is now rotating in the second rotational direction. This applies correspondingly to the inlet of the pump, which becomes the outlet after the rotational direction of the pump has changed. In both rotational directions, the inlet ports into a low-pressure region of the pump and the outlet ports into a high-pressure region of the pump. Switching the rotational direction of the pump thus changes the delivery flow direction through the pump of the medium to be delivered; in other words, the pump is a re-routable rotary pump.

The medium to be pumped can in particular be a lubricant and/or coolant, such as a lubricating or cooling oil, which is fed from the high-pressure side of the pump to one or more assemblies via flexible tubes, channels or conduits, in order to lubricate and/or cool the assemblies. It can however also be a medium with a different purpose, for example a fuel oil, heavy oil or diesel, which is simultaneously used for lubricating the rotor bearing. The low-pressure side of the pump can be fluidically connected to a reservoir for the medium to be pumped.

The rotary pump preferably comprises at least two sealing stays which axially face the rotor and respectively separate the low-pressure region from the high-pressure region in the rotational direction of the rotor. The sealing stays are respectively arranged between the inlet and the outlet, as viewed along the rotational direction. The sealing stays are preferably arranged oppositely. One of the sealing stays is formed in the region of maximum toothed engagement of the rotor and is also referred to as the driving stay. The other sealing stay is formed in a region of minimum toothed engagement of the rotor or in a region of no toothed engagement of the rotor. The lubricant feed is preferably formed in the so-called driving stay, i.e. in the stay in the region of maximum toothed engagement of the rotor. It is in principle conceivable for the lubricant feed to additionally or alternatively be formed in the sealing stay in the region of minimum toothed engagement of the rotor or in the region of no toothed engagement of the rotor. The sealing stays exhibit respective extents, orientated in the rotational direction, which are preferably different from each other. The sealing stay in the region of maximum toothed engagement of the rotor exhibits an extent, orientated in the rotational direction, which is preferably smaller than the extent of the sealing stay in the region of minimum toothed engagement of the rotor or in the region of no toothed engagement of the rotor.

The lubricant feed is preferably suitable for reliably supplying the bearing of the rotor with the lubricant, independently of the rotational direction of the pump. The medium to be pumped is preferably fed to the bearing by the lubricant feed from at least one self-contained working chamber which is delineated in the rotational direction by the at least one rotor. In the working chamber, the medium to be pumped is transported from the low-pressure region to the high-pressure region by the rotation of the at least one rotor, wherein the volume of the working chamber changes with the rotation of the at least one rotor. In the case of a toothed wheel pump, the working chambers are delineated and/or closed off in the rotational direction by the teeth of the rotors.

The lubricant feed preferably feeds a medium which is compressed by reducing the size of the working chamber, and/or a compressed medium to be pumped, from the self-contained working chamber to the bearing. The lubricant feed is arranged in the region of toothed engagement in which compression pressures can occur which are independent of the rotational direction. Compression pressures arise in particular when the self-contained working chambers for the medium which are formed by the rotating rotor are sealed again on the pressure side by the outlet even before they have been completely emptied. The residual medium is then further compacted. This can cause energy losses in the pump or a hard movement of the rotor and can be avoided by channeling the medium back into the pump space via bores, in order to reduce the exposure of the rotor to the compression pressure. In accordance with the present invention, the compressed medium to be pumped can be discharged via the lubricant feed, such that providing the relief bores is no longer necessary, i.e. the compression pressures occurring in the pump can advantageously be used to purposefully guide the compressed lubricant to the bearing and use it there for lubricating the bearing. Omitting the bores for feeding back the medium from the compression region can help towards lower manufacturing costs.

The inlet and the outlet can be arranged symmetrically or asymmetrically with respect to each other. The symmetrical arrangement of the inlet and the outlet means that the geometry of the pump is identical in both rotational directions in relation to the inlets and outlets. The inlet and the outlet are shaped at least substantially identically. In particular when the inlet and the outlet are arranged symmetrically, the lubricant feed is arranged centrically in the sealing stay. If arranged centrically, the lubricant feed exhibits an at least substantially identical distance from a nearest edge of the mutually facing ends of the outlet and inlet. The centric or central arrangement means that the geometry of the pump is identical in both rotational directions in relation to the lubricant feed. The inlet and the outlet are preferably embodied to be reniform.

In particular when the inlet and the outlet are arranged asymmetrically, the lubricant feed is arranged eccentrically in the sealing stay. This can be expedient when the rotary pump has a preferred first rotational direction and a less preferred second rotational direction, wherein the eccentrically arranged lubricant feed is preferably arranged nearer the outlet for the medium to be pumped which is envisaged for the preferred rotational direction. The eccentric arrangement of the lubricant feed is advantageous in this case, since during main operations in the preferred rotational direction, a distance between the lubricant feed and the outlet is smaller than if it were arranged centrically, thus even more reliably preventing the lubricant feed from being able to short-circuit with the inlet.

The rotary pump can be an internal-axle pump such as for example a rotary piston pump, a reciprocating piston pump, a vane cell pump, an internally toothed wheel pump or other internal-axle pump which is known in the prior art, or an external-axle pump such as for example an externally toothed wheel pump. The rotary pump is preferably a toothed wheel pump, in particular an internally toothed wheel pump.

The lubricant feed can be a groove or channel in the sealing stay or can comprise a groove and/or a channel. The groove or channel can be embodied to be rectangular, U-shaped, V-shaped or otherwise shaped in a section transverse to its longitudinal axis. A width and a length of the groove or channel can be adapted to the rotary pump. The end of the groove or channel which faces the bearing and/or the end of the groove or channel which faces away from the bearing can be funnel-shaped. The longitudinal sides of the groove or channel can extend in parallel with each other or can be inclined towards or away from each other in the direction of the bearing, such that a width of the groove or channel continuously changes over its length. This can apply similarly to the depth of the groove or channel. The shape—such as the length, width and depth—of the groove or channel is not in principle defined but can rather be freely selected by the person skilled in the art. The groove or channel advantageously exhibits a width, i.e. an extent orientated in the rotational direction, of at least 0.5 mm and particularly advantageously at least 1 mm. The groove or channel preferably exhibits a width, i.e. an extent orientated in the rotational direction, of between 0.5 mm and 3 mm and particularly advantageously between 1 mm and 1.5 mm. A groove or channel can also be divided like a delta, such that at least one of the ends of the groove or channel comprises multiple arms. Lastly, the groove or channel need not form a straight line, but rather can for example be curved. The groove or channel can also comprise at least one throttle path which is in particular arranged centrically with respect to a main extent of the groove or channel and which is in particular distinguished by a flow cross-section which is reduced in size as compared to the beginning and end of the groove and/or channel.

The lubricant feed can comprise a pocket in the sealing stay. The pocket can terminate directly at the bearing or can be connected to the bearing via a groove or channel. The pocket can be round, oval, rectangular, funnel-shaped or otherwise shaped in its length, width and depth.

The lubricant feed cannot be short-circuited with the inlet into the pump space or the outlet out of the pump space in any position of the rotor. This prevents too much lubricant being pressed into the lubricant feed if the lubricant feed is directly connected to the outlet or high-pressure region of the pump, and compression pressures occurring in the region of maximum toothed engagement of the pump despite the lubricant feed. A short-circuit with the inlet or suction side of the pump can reduce, prevent or even reverse a flow of the lubricant to the bearing via the lubricant feed, which could cause an insufficient supply of lubricant to the bearing. This could result in damage up to and including the destruction of the rotary pump.

An imaginary extension of the groove or channel or, respectively, of an axial centre axis (longitudinal axis) of the groove or channel can intersect a rotary axis of the rotor or a straight line which extends in parallel with the rotary axis of the pump, i.e. the imaginary extension of the groove or channel can meet a circumferential outer surface of the bearing at least in one point, perpendicularly or at an angle which can be predetermined by the design. The imaginary extension of the groove or channel is preferably orientated in parallel with an eccentric line, as viewed in a cross-section of the rotary pump which is orthogonal with respect to the rotary axis of the at least one rotor. Particularly advantageously, the imaginary extension or centre axis of the groove or channel lies on the eccentric line in the cross-section, in particular if the inlet and the outlet are arranged or embodied asymmetrically with respect to each other. An "eccentric line" is to be understood in particular to mean a straight line which connects a centre point of the rotor and a centre point of the pump space to each other, as viewed in the cross-section of the rotary pump, or connects the rotary axis of an inner rotor and the rotary axis of an outer rotor of the rotary pump to each other.

In the sealing stay, which is formed between the inlet and the outlet in the rotational direction of the rotor, the lubricant feed can extend from the bearing to between the inlet and the outlet. In particular when a rotary pump is embodied as a toothed wheel pump, the lubricant feed preferably extends radially from the bearing up to at least a root circle diameter of one of the toothed wheels, for example up to at least a root circle diameter which is radially furthermost from the bearing. In particular when a rotary pump is embodied as an internally toothed wheel pump, the lubricant feed preferably extends radially from the bearing up to at least a root circle diameter of an externally toothed wheel, i.e. up to at least the root circle diameter which is radially furthermost from the bearing, wherein if the lubricant feed is groove-shaped, the end of the lubricant feed which faces the bearing can be open and the end of the groove-shaped lubricant feed which faces away from the bearing and has no pocket can be closed. The end of the lubricant feed which faces the bearing can port into the bearing, such that lubricant passes directly from the lubricant feed to the bearing. The bearing can in particular be an annular gap which extends around a drive shaft of the at least one rotor. The lubricant feed can extend from the bearing to near the point of maximum toothed engagement, thus enabling the compressed medium to be pumped to be fed to the bearing substantially completely via the lubricant feed. For this purpose, the sealing stay can be wider than in comparable rotary pumps of the prior art, which can increase the lubricating pressure and/or improve the seal with respect to the inlet into the pump space and/or the outlet out of the pump space.

The pump space is generally delineated at its axial ends by a cover and a base. The inlet, the outlet, the sealing stay and the lubricant feed can optionally be formed in the cover of the pump space or in the base of the pump space or in both the cover and the base of the pump space, i.e. the rotary pump can comprise two inlets into the low-pressure region of the pump space, two outlets out of the high-pressure region of the pump space, two sealing stays—in particular, driving stays—which axially face the rotor and separate the low-pressure region from the high-pressure region in the rotational direction of the rotor, and a lubricant feed in each of the two sealing stays, in particular in the region of maximum toothed engagement of the rotor. The two axially opposite lubricant feeds, i.e. the lubricant feed incorporated in the base and the lubricant feed incorporated in the cover, can differ in their form, depth, length, width and/or the like. The two axially opposite lubricant feeds can also be orientated such that they are offset and/or rotated with respect to each other in relation to the rotational direction. It is in principle conceivable for one of the lubricant feeds to be arranged eccentrically and nearer the outlet for the medium to be pumped which is envisaged for the preferred rotational direction, and for the axially opposite lubricant feed to be arranged eccentrically and nearer the inlet for the medium to be pumped which is envisaged for the preferred rotational direction, wherein the axially opposite lubricant feeds can differ from each other, for example in the size of their groove or channel.

The rotary pump or the lubricant and/or coolant system which comprises the rotary pump preferably comprises at least one blocking valve which is arranged between the pump space and a lubricant and/or coolant reservoir from which the rotary pump suctions a lubricant and/or coolant in at least one operating state. The blocking valve advantageously blocks a flow from the pump space into the lubricant and/or coolant reservoir and allows a flow from the lubricant and/or coolant reservoir into the pump space. It is also advantageous if the rotary pump or the lubricant and/or coolant system comprises at least one diversion which is arranged between the pump space and the lubricant and/or coolant reservoir, wherein it is advantageous if the blocking valve is arranged between the diversion and the lubricant and/or coolant reservoir.

The rotary pump is advantageously at least partially immersed in the lubricant and/or coolant in the lubricant and/or coolant reservoir and/or is arranged at least partially beneath a surface of the lubricant and/or coolant. Alternatively, the rotary pump can be arranged above the surface of the lubricant and/or coolant and is not immersed in the lubricant and/or coolant. In particular when the rotary pump is arranged above the surface of the lubricant and/or coolant, the rotary pump or the lubricant and/or coolant system which comprises the rotary pump comprises the blocking valve in order to prevent the pump space from running dry. The blocking valve can ensure that the pump space is always filled with the lubricant and/or coolant and that lubricant is supplied via the lubricant feed, in particular when the rotary pump is arranged above the surface of the lubricant and/or coolant. The blocking valve is preferably embodied as a reflux valve.

It is also in principle conceivable for the rotary pump to additionally comprise a lubricant drain which drains a lubricant from the bearing. The lubricant drain can connect the bearing to the inlet/outlet. The lubricant drain preferably comprises at least one groove or channel which extends from the bearing to the inlet/outlet. The lubricant drain is advantageously formed in the base and/or cover. The lubricant drain preferably exhibits a flow cross-section which is smaller than the lubricant feed, at least in a partial portion, and/or comprises a throttle point, for example in the form of a constriction.

BRIEF DESCRIPTION OF THE DRAWINGS

In the following, the invention is described in more detail on the basis of figures. The figures show example embodiments of a rotary pump, without this restricting the invention to the embodiments shown in the figures. Features essential to the invention which can only be gathered from the figures can advantageously develop the rotary pump of the invention, individually or in combination. Specifically.

DETAILED DESCRIPTION OF THE INVENTION

Figure 1:
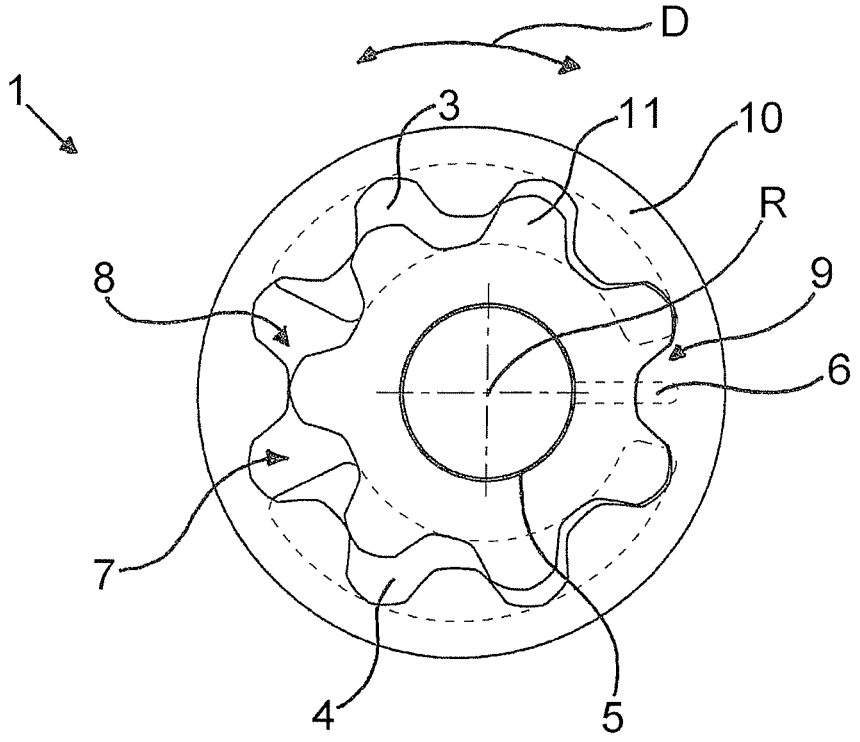
FIG. 1 shows a rotor set of a rotary pump, comprising one rotor embodied as an internally toothed wheel and one rotor embodied as an externally toothed wheel.

FIG. 1 shows a rotary pump 1 of a motor vehicle. The rotary pump 1 is embodied as an internally toothed wheel pump, internally toothed ring pump or gerotor pump. The delivery direction or rotational direction D of the rotary pump 1 can be switched during operation. The rotary pump 1 comprises a rotor set comprising one rotor 10 embodied as an externally toothed wheel and one rotor 11 embodied as an internally toothed wheel, which are arranged eccentrically with respect to each other. The rotor 10 can serve as a stator within which the rotor 11 is arranged eccentrically. The rotor 10 can however also be rotated, for example rotated along with and by the rotor 11. The designations "rotor 10" and "rotor 11" are therefore maintained for the purposes of the description. The two rotors 10 and 11 together embody a pump space 7 which is filled with a medium to be pumped and in which the medium is compacted on its way from the inlet to the outlet. The rotors 10, 11 delineate and/or form multiple working chambers, as viewed in the rotational direction D, in which the medium to be pumped is transported. The rotors 10, 11 divide the pump space 7 into multiple working chambers which change their volume when the rotors 10, 11 rotate.

In order to be driven, the rotary pump 1 comprises an electric motor (not shown) which is attached in drive terms to the rotor 11. The electric motor is provided in order to drive the rotor 11 in both rotational directions D. The rotary pump is embodied as an auxiliary and/or additional pump for assisting and/or at least partially replacing a main or primary pump of the motor vehicle. The rotary pump 1 is arranged in a lubricant and/or coolant system of the motor vehicle.

The rotary pump 1 also comprises a housing 2 (not shown in FIG. 1) which can form a base of the pump space 7, comprising an inlet/outlet 4, an outlet/inlet 3, a bearing 5 for the rotor 11 and two sealing stays 8 and 9 (cf. also FIG. 2) formed between the inlet/outlet 4 and the outlet/inlet 3. When the rotational direction is reversed, the inlets/outlets 3, 4 change their function. If a rotational direction D is in the clockwise direction, the inlet/outlet 4 is embodied as an inlet and the outlet/inlet 3 is embodied as an outlet. If a rotational direction D is in the anti-clockwise direction, the inlet/outlet 4 is embodied as an outlet and the outlet/inlet 3 is embodied as an inlet. For the sake of simplicity, the inlet/outlet 4 is referred to as the inlet 4 and the outlet/inlet 3 is referred to as the outlet 3 in the following. The inlet 4 and the outlet 3 are embodied symmetrically with respect to each other.

In order to lubricate the bearing 5 independently of the rotational direction, a lubricating groove which is incorporated in the sealing stay 9 forms a lubricant feed 6 using which compression oil is channeled as a lubricant from the pump space 7 to the bearing 5 of the rotor 11. The lubricant feed 6 feeds compression oil from one of the working chambers to the bearing 5 of the rotor 11. The lubricant feed 6, i.e. the lubricating groove, is formed in the region of maximum toothed engagement of the rotors 10, 11, i.e. in the region in which a tooth of the rotor 11 engages substantially completely with a region between two teeth of the rotor 10. The lubricant feed 6 is supplied with a residual medium which has not been displaced through the outlet 3 and which is charged with a compression pressure when the rotor 11 rotates further. Since the compressed medium negatively affects the performance of the rotary pump 1 and can hasten wear on the rotary pump 1, an attempt is made to avoid such compression pressures occurring, by displacing the residual medium back into the pump space 7 or the inlet 4, for example via bores in the rotor 10, 11, in pumps of the prior art. In the example embodiment of the invention, the compressed medium is advantageously discharged in this way via the lubricant feed 6, and the medium is used for lubricating the bearing 5 of the rotor 11.

In the example embodiment shown, the lubricant feed 6 is arranged centrically in the sealing stay 9, i.e. a distance between the lubricant feed 6 and the outlet 3, which connects a high-pressure side of the rotary pump 1 to for example conduits, and a distance from the inlet 4 which is assigned to the low-pressure side of the rotary pump 1 are identical or substantially identical. The lubricant feed 6 does not have a fluidic connection either to the outlet 3 or to the inlet 4. The centric arrangement of the lubricant feed 6 within the sealing stay 9 has the advantage that the lubricant feed 6 is reliably supplied with lubricant from the pump space 7 irrespective of a rotational direction of the rotary pump 1, i.e. a rotational direction of the rotors 10, 11. It can be advantageous if the sealing stay 9 is wider than in pumps of the prior art, i.e. a distance between the edges of the inlet 4 and outlet 3 which face each other and define a minimum width of the sealing stay 9 is selected to be larger than in comparable pumps which do not have the lubricant feed 6.

The lubricant feed 6 is open at its ends assigned to the bearing 5 and ports onto an outer surface of the bearing 5, whence it extends radially outwards into the sealing stay 9 and terminates in a region of the sealing stay 9 which lies between the inlet 4 and the outlet 3. The lubricant feed 6 is formed as a recess in the base of the pump space 7. The sealing stay 9, together with the rotors 10, 11, separates the low-pressure region of the pump space 7 from the high-pressure region of the pump space 7 and prevents a medium to be pumped from being able to flow directly from the inlet 4 into the outlet 3. The other sealing stay 8 also has the same function, i.e. that of preventing a direct fluidic connection between the inlet 4 and the outlet 3, although unlike the sealing stay 9, a toothed engagement between the internally toothed wheel 11 and the externally toothed wheel 10 is lacking or is at a minimum in the region of the sealing stay 8.

The medium to be pumped can for example be an oil, heavy oil, diesel or other medium which has sufficient lubricating properties to reliably lubricate the bearing 5 of the rotor 10. In this example embodiment, it is a lubricating oil for lubricating and/or cooling motor vehicle components.

Figure 2:
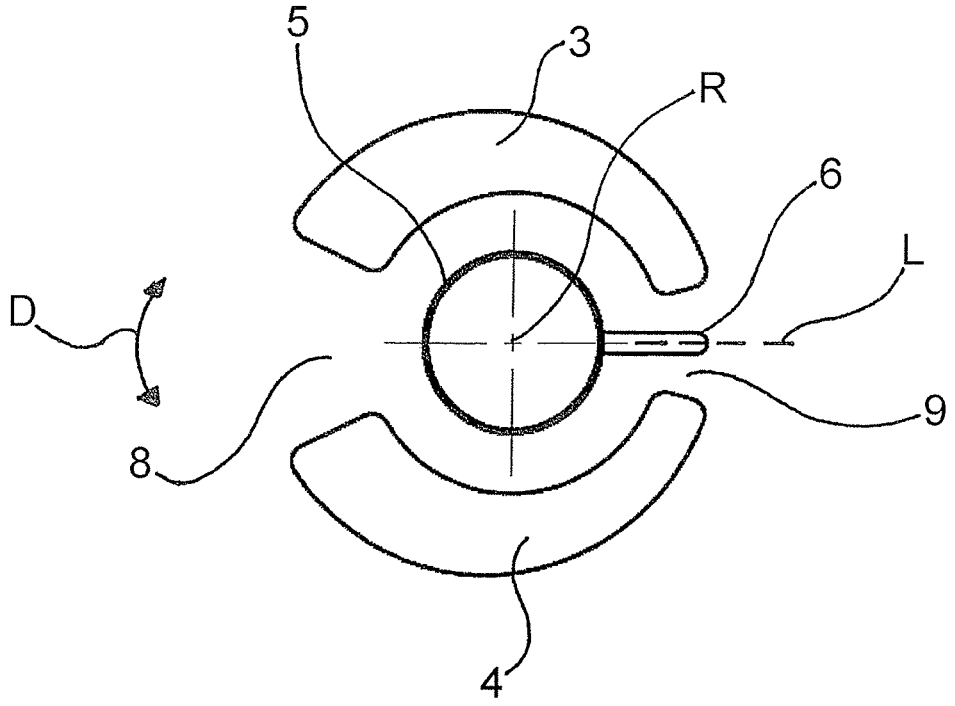
FIG. 2 schematically shows an inlet, an outlet and a sealing stay comprising a centrically arranged lubricant feed of the rotary pump from FIG. 1.

The lubricant feed 6 or, respectively, an extension of an axial longitudinal axis L of the lubricant feed 6 which is indicated in FIG. 2 intersects the rotary axis R of the rotor 11. The rotor 11 can be rotary-driven and can be rotated relative to the housing 2 only and, optionally, linearly adjusted along the rotary axis R, i.e. the rotary axis R of the rotary pump 1 of the example embodiment does not change its position relative to the housing 2.

The rotary pump 1 likewise comprises a bearing in order to mount the rotor 10. As an alternative to or in addition to supplying the bearing 5 with lubricating oil, the lubricant feed 6 can in principle supply the bearing of the rotor 10 with the compression oil in order to lubricate it. The lubricating groove can for example be extended radially outwards and supply both bearings with compression oil. It is alternatively or additionally possible to incorporate an additional, in particular parallel lubricating groove which supplies the bearing of the rotor 10 with compression oil, wherein the lubricating grooves can take their compression oil from the same working chamber or from two different working chambers.

Figure 3:
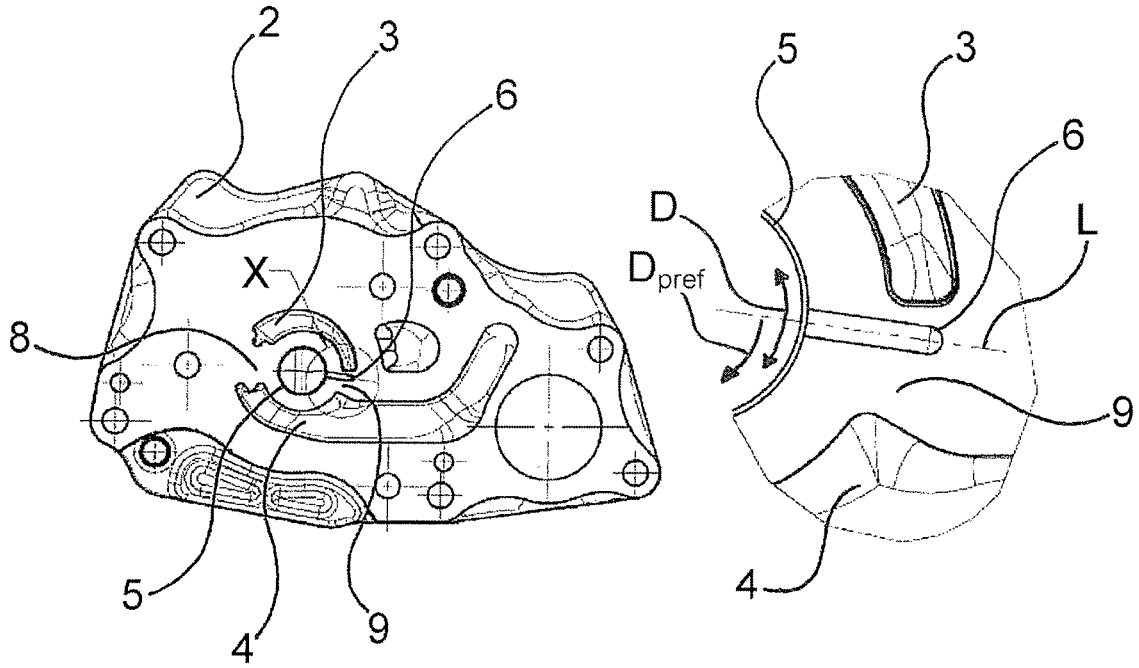
FIG. 3 shows an open pump housing in a view onto an axial inner side of a pump, plus a detailed view.
Figure 4:
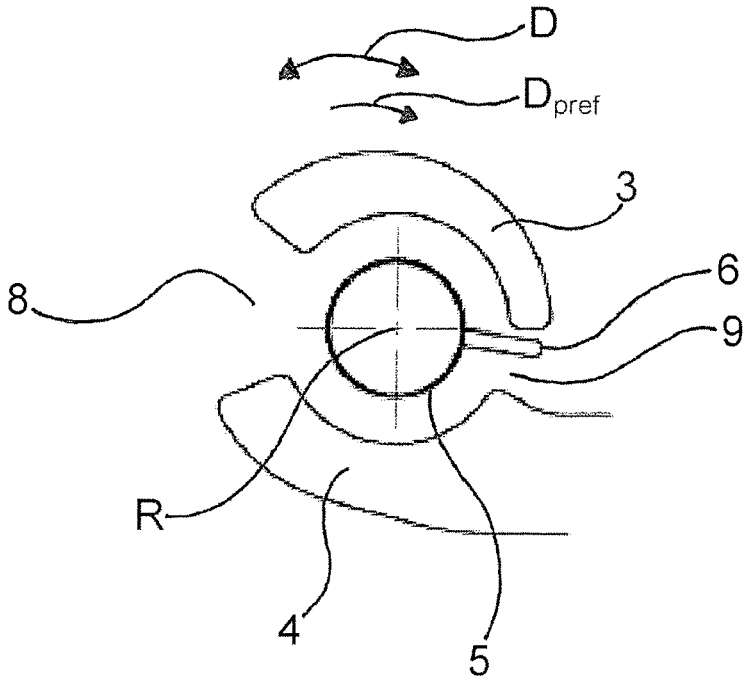
FIG. 4 shows a drawing of the pump inlet, pump outlet and sealing stay comprising an eccentrically arranged lubricant feed of the rotary pump from FIG. 3.
Figure 5:
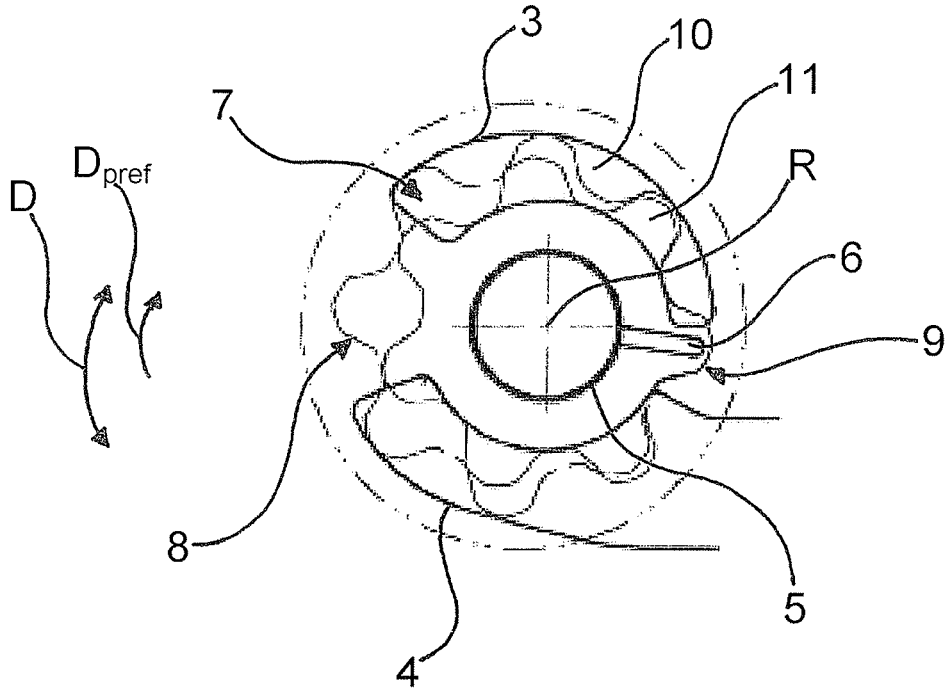
FIG. 5 shows the drawing from FIG. 4, together with the pump space and rotor.

FIGS. 3, 4 and 5 show a rotary pump 1 of a second example embodiment, wherein FIG. 3 shows a view into a housing 2 of the rotary pump 1. The housing 2 comprises an inner side wall which can form a base of a pump space 7, comprising an inlet 4, an outlet 3, a bearing 5 for a rotor 11 and two sealing stays 8 and 9 formed between the inlet 4 and the outlet 3. A lubricating groove which is incorporated in the sealing stay 9 forms a lubricant feed 6 using which compression oil is channeled as a lubricant from the pump space 7 to the bearing 5 of the rotor 11.

In the second example embodiment, the inlet 4 and the outlet 3 are embodied asymmetrically, wherein the lubricant feed 6 is arranged eccentrically in the sealing stay 9, i.e. a distance between the lubricant feed 6 and the outlet 3 envisaged for a preferred rotational direction $D_{pref}$, the outlet 3 connecting a high-pressure side of the rotary pump 1 to for example conduits, is smaller than a distance from the inlet 4 envisaged for the preferred rotational direction $D_{pref}$, the inlet 4 being assigned to the low-pressure side of the rotary pump 1. The eccentric arrangement of the lubricant feed 6 within the sealing stay 9 is in particular advantageous if the rotary pump 1 has a preferred rotational direction $D_{pref}$. In this case, arranging the lubricant feed 6 in this way increases the size of the region of the sealing stay 9 which seals the lubricant feed 6 with respect to the low-pressure side or the inlet 4, such that the lubricant is reliably prevented from being suctioned out of the lubricant feed 6 again through a fluidic connection between the lubricant feed 6 and the inlet 4. The axial longitudinal axis L of the lubricant feed 6 lies on a straight eccentric line which, in a cross-section of the rotary pump 1, connects a rotary axis of the rotor 10 and a rotary axis of the rotor 11 to each other. Although the longitudinal axis L of the lubricant feed 6 is preferably congruent with the eccentric straight line which connects the rotary axis of the rotor 10 and the rotary axis of the rotor 11, the longitudinal axis L of the lubricant feed 6 can instead however also, in modifications, extend in parallel with the eccentric straight line at a distance. In other modifications, the longitudinal axis L can in principle extend at an acute angle of preferably less than 20° to the eccentric straight line and intersect the rotary axis of the rotor 10 and/or the rotary axis of the rotor 11 or intersect it/them at a distance.

The lubricant feed 6 can also, unlike FIGS. 3, 4 and 5, be arranged in the sealing stay 9 eccentrically and nearer the inlet 4 envisaged for the preferred rotational direction $D_{pref}$, in order to reliably prevent a fluidic connection between the outlet 3 envisaged for the preferred rotational direction $D_{pref}$ and the lubricant feed 6. This can for example be advantageous in rotary pumps 1 having a high outlet pressure, in order to reliably prevent the highly pressurised medium from being pressed into the lubricant feed 6 before the outlet 3 of the rotary pump 1 is completely closed. The region of the sealing stay 9 is additionally shown in an enlarged representation.

Figure 6:
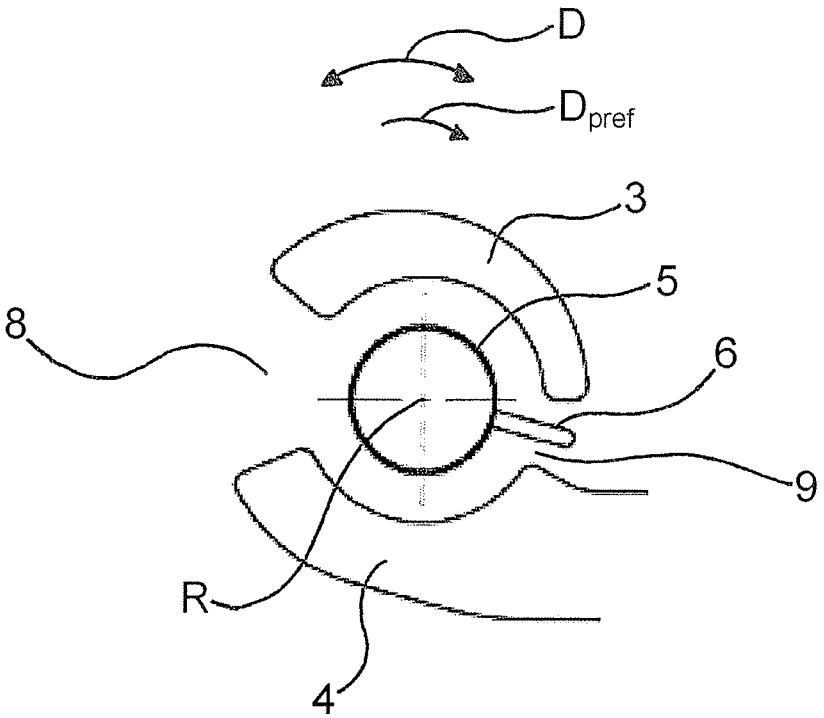
FIG. 6 shows a drawing of the pump inlet, pump outlet and sealing stay comprising a centrically arranged lubricant feed.
Figure 7:
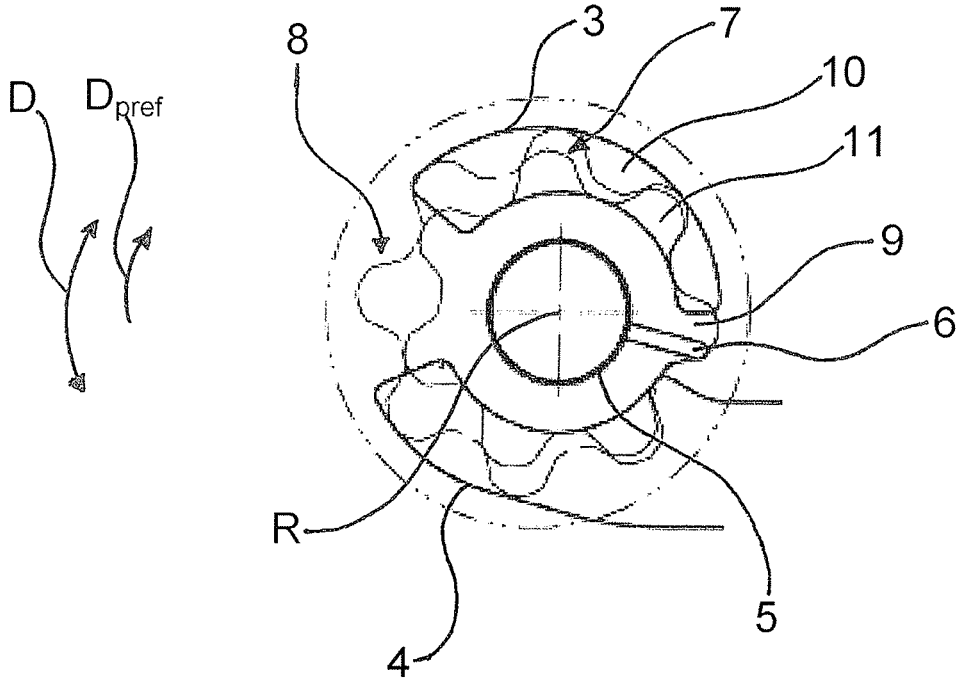
FIG. 7 shows the drawing of FIG. 6, together with the pump space and rotor.

FIGS. 6 and 7 show a rotary pump 1 in a third example embodiment. Unlike the example embodiment in FIGS. 1 and 2, the inlet 4 and outlet 3 are embodied asymmetrically. Unlike the example embodiment in FIGS. 3, 4 and 5, the lubricant feed 6 is arranged centrically in the sealing stay 9, i.e. it has substantially identical distances from the inlet 4 and the outlet 3. The rotary pump 1 therefore comprises inlets and outlets 3, 4 which are embodied asymmetrically with respect to each other, but a lubricant feed 6 which is arranged centrically.

LIST OF REFERENCE SIGNS

1 rotary pump
2 housing
3 outlet
4 inlet
5 bearing
6 lubricant feed
7 pump space
8 sealing stay
9 sealing stay
10 rotor
11 rotor
D rotational direction
$D_{pref}$ preferred rotational direction
R rotary axis of the rotor
L longitudinal centre axis of the lubricant feed

The invention claimed is:

1. A rotary pump which selectively rotates in a clockwise direction and in a counterclockwise direction, comprising:

a) a housing which comprises a pump space featuring an inlet into a low-pressure region of the pump space for a medium to be pumped and an outlet out of a high-pressure region of the pump space for the medium to be pumped;

b) at least one rotor;

c) at least one bearing for the at least one rotor;

d) at least one sealing stay which axially faces the rotor and separates the low-pressure region from the high-pressure region in the rotational direction of the rotor;

e) and a lubricant feed which feeds a lubricant from the pump space to at least the bearing, when the rotor rotates in the clockwise or the counterclockwise direction, respectively, f) wherein the lubricant feed is formed in the sealing stay, g) and wherein the rotary pump is an internal-axle pump.

2. The rotary pump according to claim 1, wherein the medium to be pumped is fed by the lubricant feed to at least the bearing from at least one self-contained working chamber which is delineated in the rotational direction by the at least one rotor.

3. The rotary pump according to claim 1, wherein the lubricant feed is formed in the sealing stay in a region of maximum toothed engagement of the rotor.

4. The rotary pump according to claim 1, wherein the inlet and the outlet are embodied symmetrically with respect to each other.

5. The rotary pump according to claim 1, wherein the lubricant feed is arranged centrically in the sealing stay.

6. The rotary pump according to claim 1, wherein the lubricant feed is arranged eccentrically in the sealing stay.

7. The rotary pump according to claim 1, wherein the internal-axle pump is an internal gear pump.

8. The rotary pump according to claim 1, wherein the lubricant feed is a groove or channel in the sealing stay or comprises at least one groove and/or channel.

9. The rotary pump according to claim 8, wherein an imaginary extension of the groove or channel is arranged on a straight eccentric line which connects to each other a centre point of the pump space and the rotary axis of the at least one rotor or the rotary axes of at least two rotors, which are arranged eccentrically with respect to each other.

10. The rotary pump according to claim 1, wherein the lubricant feed comprises at least one pocket in the sealing stay and the pocket is connected to the bearing directly or via a groove or channel.

11. The rotary pump according to claim 1, wherein the lubricant feed is not short-circuited with the inlet into the pump space or the outlet out of the pump space in any position of the rotor.

12. The rotary pump according to claim 1, wherein an imaginary extension of the groove or channel intersects a rotary axis or an axis in parallel with the rotary axis of the pump.

13. The rotary pump according to claim 1, wherein the sealing stay) is formed between the inlet and the outlet in the rotational direction of the rotor, and the lubricant feed extends from the bearing to at least between the inlet and the outlet.

14. The rotary pump according to claim 1, where the pump is a toothed wheel pump, wherein the lubricant feed extends from the bearing up to at least a root circle diameter of one of the toothed wheels.

15. The rotary pump according to claim 1, wherein the pump space comprises an axial cover and an axial base, and the inlet, the outlet, the sealing stay and the lubricant feed are formed in the axial cover and/or axial base of the pump space.

16. The rotary pump according to claim 1, further comprising an electric motor for driving the rotary pump.

17. The rotary pump according to claim 1, wherein the pump is an auxiliary and/or additional pump for assisting and/or at least partially replacing a main pump in a lubricant and/or coolant system of a motor vehicle.

18. The rotary pump according to any one of claim 1, wherein the lubricant feed is arranged eccentrically in the sealing stay nearer the outlet for the medium to be pumped which is envisaged for a predetermined rotational direction.

19. The rotary pump according to claim 1, wherein the rotary pump is an internally toothed wheel pump.

20. The rotary pump according to claim 1, wherein the pump is a toothed wheel pump, wherein the lubricant feed extends from the bearing up to at least a root circle diameter which is radially furthermost from the bearing.

* * * * *